United States Patent [19]

Braiotta

[11] Patent Number: 4,782,883

[45] Date of Patent: Nov. 8, 1988

[54] FABRIC WALL COVERING SYSTEM

[75] Inventor: Dominick C. Braiotta, 252B Stonegate, Nissequogue, N.Y. 11789

[73] Assignees: Marc Eiseman, Bayside; Dominick C. Braiotta, Nissequogue, both of N.Y.

[21] Appl. No.: 32,039

[22] Filed: Mar. 30, 1987

[51] Int. Cl.[4] ..... A47H 23/00

[52] U.S. Cl. ..... 160/368.1; 160/327

[58] Field of Search ..... 160/327, 392, 371, 381, 160/404, 368; 52/273; 248/205.2, 205.3

[56] References Cited

U.S. PATENT DOCUMENTS 3,657,850 4/1972 Billarant .
3,780,479 12/1973 Billarant et al. .
3,822,734 7/1974 Tombu ..... 160/327 X
3,833,046 9/1974 Tombu ..... 160/327
3,928,897 12/1975 Tombu .
4,018,260 4/1977 Baslow .
4,053,008 10/1977 Baslow .
4,625,490 12/1986 Baslow .

*Primary Examiner*—Robert W. Gibson, Jr.
*Attorney, Agent, or Firm*—Scully, Scott, Murphy & Presser

[57] ABSTRACT

A system or arrangement for the non-adherent mounting of a fabric wall covering sheet or panel on a wall surface structure. Moreover, the invention also concerns itself with a system or arrangement incorporating at least one track member which is fastenable to a wall, and wherein the track member includes fastening devices to which complementary fastening devices on the fabric sheet or panel are adapted to be detachably adhered so as to render it possible to easily cover the surface of the wall with the fabric panel without any necessity for previously preparing the surface wall or for adhering the fabric material thereto.

28 Claims, 5 Drawing Sheets

FABRIC WALL COVERING SYSTEM

BACKGROUND OF THE INVENTION

1. Field of the Invention

The present invention generally relates to fabric wall coverings and, more particularly, pertains to a system or arrangement for the non-adherent mounting of a fabric wall covering sheet or panel on a wall surface structure. Moreover, the invention also concerns itself with a system or arrangement incorporating at least one track member which is fastenable to a wall, and wherein the track member includes fastening structure to which the fabric sheet or panel is adapted to be detachably adhered so as to render it possible to easily cover the surface of the wall with the fabric panel without any necessity for previously preparing the surface of the wall or for adhering the fabric material thereto.

The concept of utilizing decorative wallpapers as wall coverings, and, in numerous instances, expensive fabrics, has captured an extensive niche in the market of wall coverings, extending over the full spectrum of industrial, commercial and home applications. In our currently substantially affluent society, the decoration and covering of the walls in homes, apartments and offices with expensive fabric wall coverings has achieved widespread acceptance. In certain instances of application, the fabrics which are to be employed as the wall coverings, are cut into appropriately-sized and configured fabic panels and directly adhered to the surfaces of the walls, possibly through the intermediary of glues, adhesives or other similar types of adhesive media. This, necessarily, requires the surfaces of the walls to which the fabric panels are adhered to be prepared so as to eliminate any undue bulges and/or irregularities in the wall surface, inasmuch as the fabric would clearly evidence any irregularities in the wall surface therethrough subsequent to adhesion of the fabric to the wall surface. Moreover, in addition to the time-consuming and expensive tasks of having to prepare the wall surfaces; for instance, taping, spackling and possibly applying liners thereto, the permanent nature of adhering the fabric material thereto requires a high degree of skill in the application thereof. Also, when it is desired to remove or strip the fabric from the wall, this procedure essentially destroys the integrity of the fabric, and also requires refinishing of the wall surface for the subsequent applying of wall coverings.

In order to ameliorate or obviate the foregoing drawbacks, there have been developed other types of systems for covering wall surfaces with fabric panels, in which suitable frame structures are fastened to the wall at expedient locations, and with the wall covering fabric sheets or panels being tensioned and then adhered to such members or structures without adhering to the wall itself. This, in an advantageous manner, eliminates the necessity for treating or finishing the surface of the wall, inasmuch as the fabric sheet or panel is somewhat spaced therefrom, and enables wall covering fabrics to be mounted on unfinished walls, such as may be constituted from cinder blocks, untaped and unspackled sheetrock, plywood or the like. It is quite evident that there are considerable savings in costs in non-adhesively fastening the fabric to a wall through the utilization of a supportive track system, and that this renders such high-quality fabric wall coverings costwise highly competitive with the normally less expensive wallpapers or wall coverings constituted of flocked paper or paper-backed fabrics which are fastened directly to the wall surfaces.

Although presently employed arrangements or installations directed to the covering of substantially unfinished or semi-finished wall surfaces with relatively expensive fabric panels have come into widespread use, and to a considerable extent overcome the limitations of previous types of fabric wall coverings which are directly adhered to the walls, due to the installation of fabric coverings over either new or old walls without the need for adhesives and wall preparation, these systems are still not especially cost-effective in that they require the utilization of either expensive frame works and track structures and/or highly skilled operators for mounting the frame structures on the walls and properly orienting and attaching the fabric panels to the former.

Another difficulty which is encountered in the employment of such fabric panel wall covering arrangements resides in that the attachment of the fabric panels to the track members is generally of a substantially permanent nature, or in any event, not readily detachable therefrom, and any error in the aligning of the fabric upon being fastened to the track members will frequently result in patterns or decorations imprinted, woven or embossed in the fabric to the improperly oriented relative to the surfaces, walls or the room in which the fabrics are displayed. This, again, requires the cost-intensive employment of highly skilled operators in initially correctly mounting the fabric panels on the track members or frames so as to again generate an increase in installation costs.

Moreover, inasmuch as the presently utilized wall covering systems mounting fabric panels require a high degree of skill in installation, the average householder, who frequently, prefers to engage in his own cost-saving labors as a so-called "do-it-yourselfer", such as painting, plumbing, and wallpapering, including the "hanging" of fabric wall coverings, is frequently unable to carry out the desired installation due to a lack in the necessary basic skills and with the result that an improper installation may damage or even completely ruin expensive mounting track components and fabric panels, so as to thereby render the entire procedure uneconomical.

2. Discussion of the Prior Art

Baslow U.S. Pat. No. 4,018,260 discloses a fabric wall covering system for attaching border pieces or frame members to a wall, which frame members include channeled openings leading to storage arrangements adapted to receive the edges or selvage of a fabric sheet mounted on a framework formed by the border pieces, to facilitate the fabric sheet to cover a wall without being adhered thereto. The aspect in that the selvage of the fabric material is disposed within a channel portion of the border pieces enables a smooth appearance to be presented by the mounted fabric sheet without any necessity for finishing the wall surface. However, the mounting of the fabric material on the border pieces and the introduction of the selvage into the channeled structure requires the employment of highly skilled operators to properly carry out the fabric wall covering installation. In addition thereto, it is extremely difficult to again release the ends or selvage of the fabric material from engagement with the channel structure because of the gripping engagement therebetween, rendering removal of the mounted fabric material almost impossible such that, in the event of an improper installation, there may be encountered damage to or even a possible loss of expensive fabric material, not to mention labor losses.

Baslow U.S. Pat. No. 4,053,008 discloses a system similar to Baslow U.S. Pat. No. 4,018,260, in which the fabric material is clamped between cooperative constituents of a framework, and also renders difficult any removal of the mounted fabric material subsequent to its installation, thereby necessitating a high degree of precision by skilled operators during installation in order to avoid any possible misalignment of the wall covering fabric material.

Billarant U.S. Pat. No. 3,657,850, although disclosing a wall-supported framework wherein a flexible material, such as a sheet or panel of a wall covering fabric, has its ends or selvage tucked into a channel provided in the framework, and with surface portions of the exposed fabric material contacting the framework being detachably adhered thereto; for example, by means of hook-and-loop fasteners, such as known under the registered trademark "Velcro". However, the ends of the fabric material which is tucked into the framework channels is not adhered to the framework, and any pulling action exerted on the fabric frequently produces an inadvertent detachment thereof.

Baslow U.S. Pat. No. 4,625,490 discloses a fabric-supporting track structure or a molding piece which is adherable to a wall, and which incorporates a protruding channel member possessing a cove with an opening into which there may be inserted the margin or selvage of the fabric, with the cove of the channel being provided with a pressure-sensitive adhesive for adhering the fabric material thereto. Again, this type of mounting arrangement for fabric panels renders removal of the latter rather difficult in the event that the material is improperly installed, and necessitates the employment of highly skilled operators for attaching the wall covering fabric to the track or molding pieces.

SUMMARY OF THE INVENTION

Accordingly, in order to obviate or ameliorate the disadvantages and drawbacks encountered in presently known systems for the non-adherent mounting of wall covering fabric sheets or panels or wall surfaces, the present invention contemplates the provision of a unique and simple track member or arrangement, preferably although not necessarily, constituted of molded or extruded plastic material, which can be readily fastened to the surface of a wall at suitable locations. The track member incorporates structure for releasably fastening or adhering the selvage or end portions of the fabric panel thereto, preferably through the use of cooperating hook-and-loop type fasteners, so as to enable the fabric to be mounted without the need for skilled operators since, in the event that the fabric material has been improperly mounted and must be repositioned, the hook-and-loop fasteners allow for detachment of the fabric from engagement with the associated track member and then to realign and refasten the fabric material to the track member.

In essence, the inventive fabric wall covering system incorporates one or more track members, each of which may be constituted of wood or either an extruded or molded metal, such as aluminum, or preferably extruded plastic material; or may be constituted of plastic laminates, wherein each of the track members possess an essentially rectangular configuration in cross-section and having flat and substantially parallel front and rear surfaces, the latter of which is adapted to adhere to a wall. At the rear of the track member, the latter is provided with a cutout or recess in the rear surface so as to essentially form an open space between the wall surface and a portion of the rear surface of the track member.

The rear surface of the track member which extends into contact with the wall so as to be adhered thereto, may be provided with a suitable adhesive medium, such as a peel and stick adhesive tape, as is well known in the art. Additionally, if desired, suitable apertures may also be formed in the track member to allow for the receipt of auxiliary fastening means, for example, screws or expansion bolts, for enhancing the strength of the fastening connection between the track member and the wall.

The opposite or front surface of the track member which faces away from the wall, is equipped with an adherent covering forming part of a hook-and-loop fastening; for instance, such as Velcro (registered trademark). Similarly, at least the recessed rear surface of the groove or space facing the wall on which the track member is mounted, is provided with a complement surface-covering type of fastener material for engaging the Velcro, in essence, a hook-and-loop fastener surface on a fabric wall covering panel, as is described in further detail hereinbelow.

The fabric panels for non-adherently covering the walls, are preferably constituted of a laminate or multilayer material including a decorative fabric layer forming its front surface portion, a foamed liner, and a backing having a suitable hook-and-loop type fastener, such as Velcro, covering the rear surface thereof. The adherable rear surface of the fabric panel is adapted to be adheringly contacted with the front surface of the track member, so as to cause the complementary hook-and-loop fastener on the panel and track member interengage, while the ends or selvage of the fabric material is adapted to be tucked into the recess or space between the recessed rear surface portion and the wall through the use of a suitable tool, so as to cause the complementary hook-and-loop fasteners on the fabric selvage portion and on the recessed rear surface of the track member to cooperatively interengage and to fasten the fabric end within the groove of the track member. The resultant fastening between the fabric and the track member, although detachable, is extremely strong in nature and, moreover, may be carried by even unskilled or semi-skilled operators, without any appreciable difficulties and without endangering the integrity of the fabric material.

Accordingly, it is an object of the present invention to provide a system for the non-adherent mounting of a fabric wall covering on a wall surface through the intermediary of the fabric-supporting track arrangement or element which is fastened to the wall.

It is a more specific object to provide a system or arrangement of the type described, in which each fabric-supporting track member includes fastening means for fastening the fabric panel thereto in manner to enable the fabric to be subsequently detached therefrom with encountering any damage, and remounted or replaced as required.

A still more specific object of the invention is to provide a track member or system adapted to be fastened to a wall surface and which includes a fastener medium for releasable adherence thereto of a complementary fastener medium on a fabric panel enabling the mounting thereof in any desired configuration or orientation on a supporting wall structure, and the subsequent detachment between the cooperating fastener media without destroying the integrity of the fabric.

BRIEF DESCRIPTION OF THE DRAWINGS

Reference may now be had to the following detailed description of preferred embodiments of a system for nonadherently mounting fabric wall covering panels on a wall, schematically showing details of the inventive support fabric-supporting components in the form of track members having the fabric panels detachably adhered thereto, taken in conjunction with the accompanying drawings; in which.

DETAILED DESCRIPTION

Figure 2:
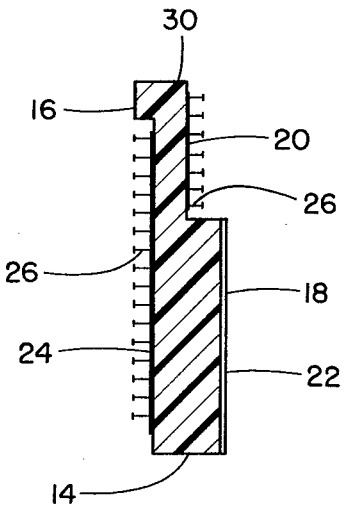
FIG. 2 illustrates, on an enlarged scale, the cross-sectional view through the track member of FIG. 1.
Figure 1:
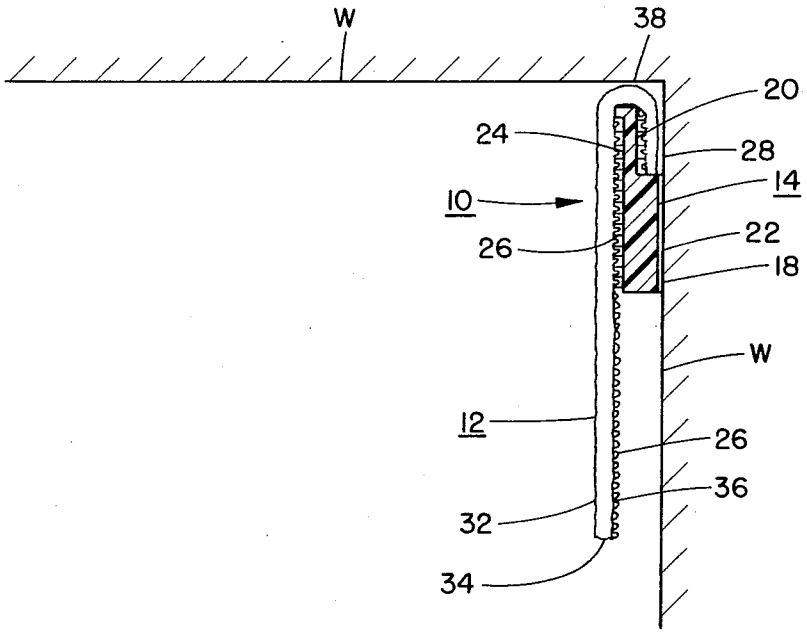
FIG. 1 illustrates, generally schematically, a transverse sectional view through a track member mounted on a wall surface and having a fabric wall covering panel adhered thereto and forming the inventive fabric wall covering system.

Referring now in detail to FIGS. 1 and 2 of the drawings, extending along a ceiling or a wall surface W, for example, that of a room, is the inventive fabric wall covering system or arrangement 10 for mounting fabric panels 12 in a non-adherent and closely spaced relationship on the wall structure W, so as to constitute a decorative fabric wall covering. The inventive track member 14, as shown more closely in the enlarged scale cross-sectional view of FIG. 2 of the drawings, is positioned to extend along the wall W and is attached to the surface of the wall, as required. The track member 14 may be constituted of a suitable extruded component 16, having a generally rectangular cross-sectional configuration, and in which the material of the track member may be either extruded aluminum, or, preferably an extruded or molded plastic element which may be cut into suitable lengths. Alternatively, instead of a plastic laminate, or even formed from wood.

The surface 18 of the track member 14 which faces the wall is provided with a recessed surface portion 20 set back and extending in parallel with surface 18, so as to provide a groove or space between the surface portion 20 and the wall surface on which the track member 14 is mounted, wherein the surface 18 is equipped with an adhesive medium 22, such as a peel-and-stick adhesive tape, enabling the track member 14 to be fastened to the surface of the wall W upon contact therewith. If required, suitable holes or apertures (not shown) may be provided in the track member 14 spaced along its length to enable the insertion thereto of fasteners, such as bolts or screws, which engage into the wall W or into suitable fastener receivers in the wall W so as to increase the strength of the attachment of the track member 14 to the wall W.

The surface 24 of the track member 14 opposite surface 18, and which faces away from the wall W, is substantially covered with a hook-and-loop type fasteners 26; in essence, filliform hooks, such as widely known under the registered trademark "Velcro", for engagement with a similar hook-like fasteners on the fabric panel 12, as discussed in detail hereinbelow. Similarly, the recessed surface portion 20 on the track member 14, which when the member 14 is attached to the wall W, forms a groove or recess 28 therebetween, is also covered with a hook-and-loop type fastener material 26. If desired, the upper end portion 30 of the track member 14 between surfaces 24 and 20 may also be covered with the hook-and-loop type fasteners 26.

The wall covering fabric panel 12 may be constituted of a laminate or multi-layered material, including a decorative material portion 32 which is laminated to a foamed liner 34 forming an intermediate layer which, in turn, is provided with a backing 36 having the hook-and-loop type fasteners 26 thereon; for example, such as Velcro, and which is adapted to engage with the complementary fasteners 26 on the track member 14 when attached to the latter. If desired, the hook-and-loop fasteners 26 on the track member 14 and on the fabric backing 36 can be formed by so-called well known "mushroom-anchor" types of hook-and-loop fasteners which will provide an increased gripping action when attaching the fabric backing 36 to the track member 14.

In order to utilize the inventive system for non-adherently mounting a fabric covering on a wall structure, wherein the latter may readily possess unfinished surfaces, such as wood, cinder block, brick, cement, or untaped and unspackled sheetrock, it is merely necessary to cut track member or members 14 to suitable length and to attach them by contacting the adhesive 22 with the surface of the wall structure W so as to leave a small gap 38, as desired, between the end 30 of the track member 14 and a ceiling or a corner of the wall W. When it is desired to cover a complete wall W with a fabric panel 12, a framework of track members 14 may be fastened to the wall so as to extend along the peripheral edges of the wall surface W; in essence, along the top, bottom, and opposite sides, thereby outlining the wall expanse. Thereafter, a suitably sized panel of a fabric material 12 commensurate with the wall dimensions is appropriately oriented relative to the track members requirements. Thereafter, an operator will adhere the edges of the fabric panel 12, one edge at a time while appropriately tensioning the fabric to eliminate any creases, to a respective track member 14 by pressing the backing 36 of the fabric material against the complementary hook-and-loop fasteners 26 on the front surface 24 of the respective track member 14, causing interengagement of the fasteners. Thereafter, the protruding edge or the selvage of the fabric material 12 is folded over the end 30 of the track member 14 through the gap 38, as shown in FIG. 1, and through the intermediary of a suitable tool (not shown) is tucked rearwardly into the recess between the surface 20 and the wall surface W, and pressed into contact with the surface 20 such that fasteners 26 on the fabric backing 36 and the complementary fasteners 26 on the surface 20 the track member 14 will interengage, and prevent the ends or selvage of the fabric material from being pulled outwardly of the recess.

In a similar manner, the hook-and-loop fasteners 26 along the other edges of the fabric backing are then engaged in sequence with the other track members 14 of the system, as described hereinabove, with concomittant stretching of the fabric material to eliminate any creases therein, and the fabric ends tucked into the recesses between the track members 14 and the wall surface W.

After the mounting of the fabric panel 12 on the track members, the narrow space which is present between the backing 36 of the fabric panel 12 and the wall surface W, due to the thickness of the track member 14, not only allows for the imparting of a smooth and finished surface appearance to the fabric panel, irrespective of the unfinished condition and any irregularities in the surface of the wall but also forms an air gap therebetween providing acoustic and thermal insulating properties to the fabric wall covering.

Figure 4:
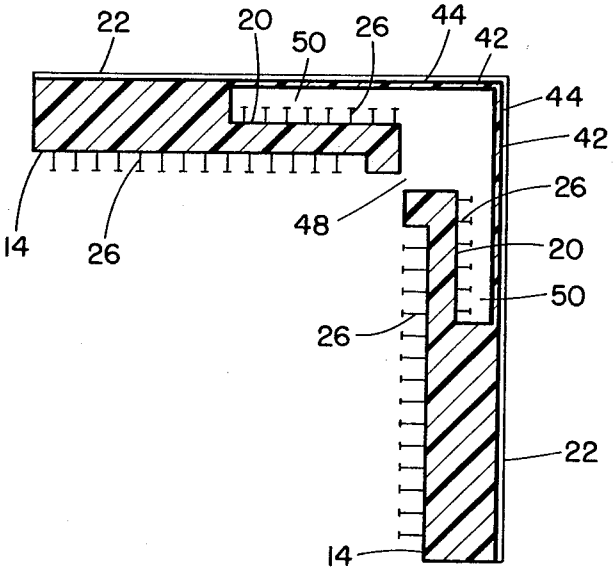
FIG. 4 illustrates, on an enlarged scale, the inside corner track member shown in FIG. 3.
Figure 3:
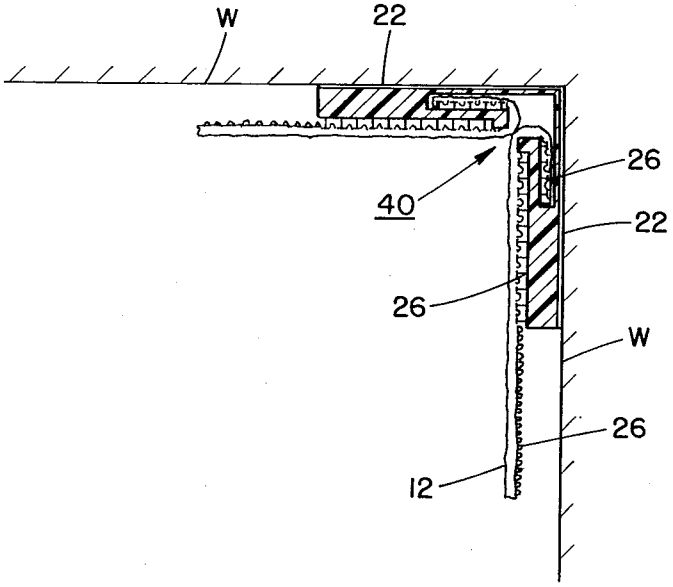
FIG. 3 illustrates a transverse sectional view through another embodiment of a system for mounting a fabric wall covering panel arrangement on an inside corner of a wall juncture.

Referring in particular to the embodiment of the fabric wall covering system or arrangement shown in FIGS. 3 and 4, in which components similar or identical to those shown in FIGS. 1 and 3 are identified by the same reference numerals, the system is adapted to be employed in connection with the mounting of fabric panels along the inside corners of adjoining wall surfaces W extending at angles to each other; in essence, a corner or edge between a ceiling and an upright wall or, alternatively, the corner between two upright walls, assuming in that case that FIG. 3 represents a top plan view instead of an elevational view.

In this embodiment, a track unit 40 is constituted of two track members 14 which are arranged at right angles to each other, and which are joined to each other by a suitable connecting plate 42 having an L-shaped configuration. The connecting plate 42 may be either integrally molded with or fastened to the respective track members 14, and have the well-contacting surfaces 44 thereof covered with an adhesive medium 2 such as a peal and stick adhesive tape, similar to that described in connection with FIG. 2 of the drawings, so as to allow the track unit 40 to be simultaneously fastened to both wall surfaces W extending at an angle to each other.

The two track members 14 are spaced apart from each other to such an extent as to provide a gap 48 between the adjacent ends 30 of a width which is sufficient to allow two thicknesses of the fabric panel 12 adhered to the respective track members 14 to pass therethrough and folded over into the recesses 50 between surfaces 20 and the facing surfaces of connecting plate 42, to thereby engage the hook-and-loop fasteners 26 provided on the surfaces 20 of the track members. This tucking procedure for the ends or selvage of the fabric panels 12 can be carried out by means of the same tool as employed in connection with FIG. 1, in effect, a curved-ended tool which merely need be reversed 180° to allow for tucking in of the end portions of the opposite fabric panels 12.

With respect to the foregoing embodiment as shown in FIGS. 3 and 4, although these are illustrated and described for a right-angled track unit 40, it is naturally also possible to contemplate that the angle between the legs and the connecting plate 42 may be either acute or obtuse in dependence upon the angle of the juncture between the adjoining walls W. Hereby, it is possible to contemplate that the angle between the legs of connecting plate be made adjustable so as to adapt the unit 40 for use at different installation angles.

Figure 6:
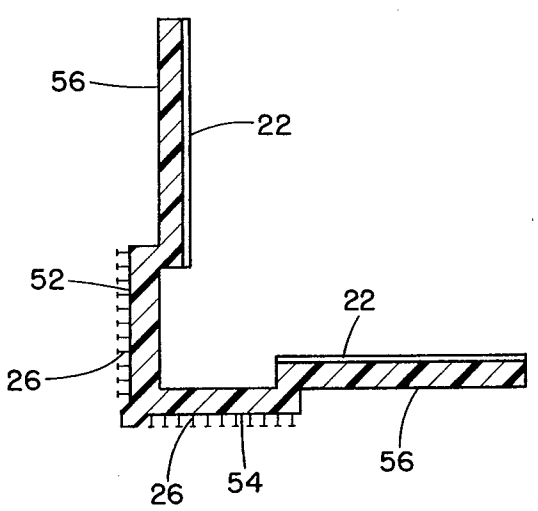
FIG. 6 illustrates, on an enlarged scale, an outside corner track member as shown in FIG. 5.
Figure 5:
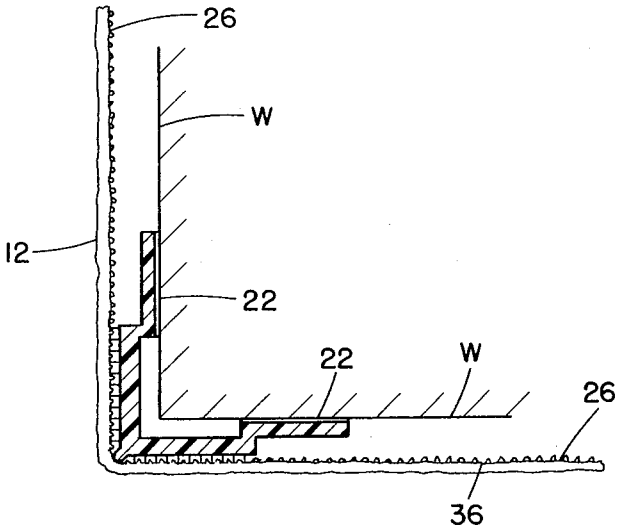
FIG. 5 illustrates a system similar to that shown in FIG. 3 for an outside corner of a wall juncture.

Similarly, with respect to the embodiment of FIGS. 5 and 6, this provides for an L-shaped track member unit 50 for the outside corners of two angularly adjoining wall surfaces W, and in which the outwardly facing surfaces of the adjoining L-shaped bracket leg portions 52, 54 are provided with the hook-and-loop fasteners 26 so as to adheringly engage the fasteners 26 on the liner 36 of the fabric panel 12 which is positioned thereabout. The inwardly facing right-angled surfaces 56 of the track member unit 50 are provided with stick and peel adhesive tape 22 so as to enable the unit 50 to be fastened to the surfaces of the walls W. Again, as in the previously described embodiment, it is possible to contemplate that the L-shaped legs may extend at angles differing from right angles; in effect, either obtusely or acutely depending upon the angle of juncture between the walls.

Figure 8:
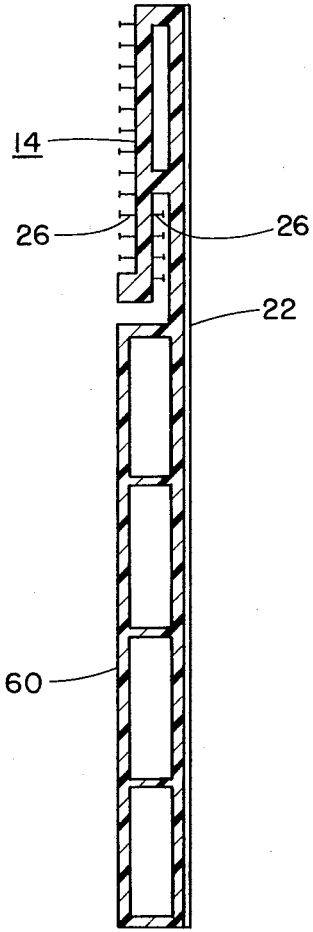
FIG. 8 illustrates, on an enlarged scale, a sectional view of the base trim track member of FIG. 7.
Figure 7:
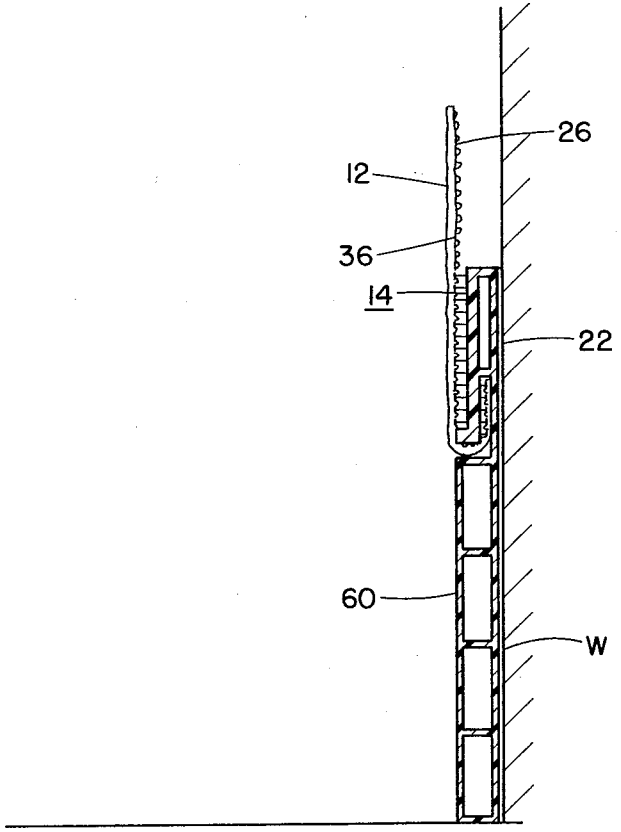
FIG. 7 illustrates the system for mounting a wall covering fabric panel along a base trim track which is fastened to a wall.

With respect to the embodiment of FIGS. 7 and 8, this illustrates the track member 14 as either being joined to or integrally formed with a base trim tracking element 60, the latter of which may be extruded from either aluminum or a plastic material or other suitable material adapted to form a decorative base trim for a wall.

Figure 9:
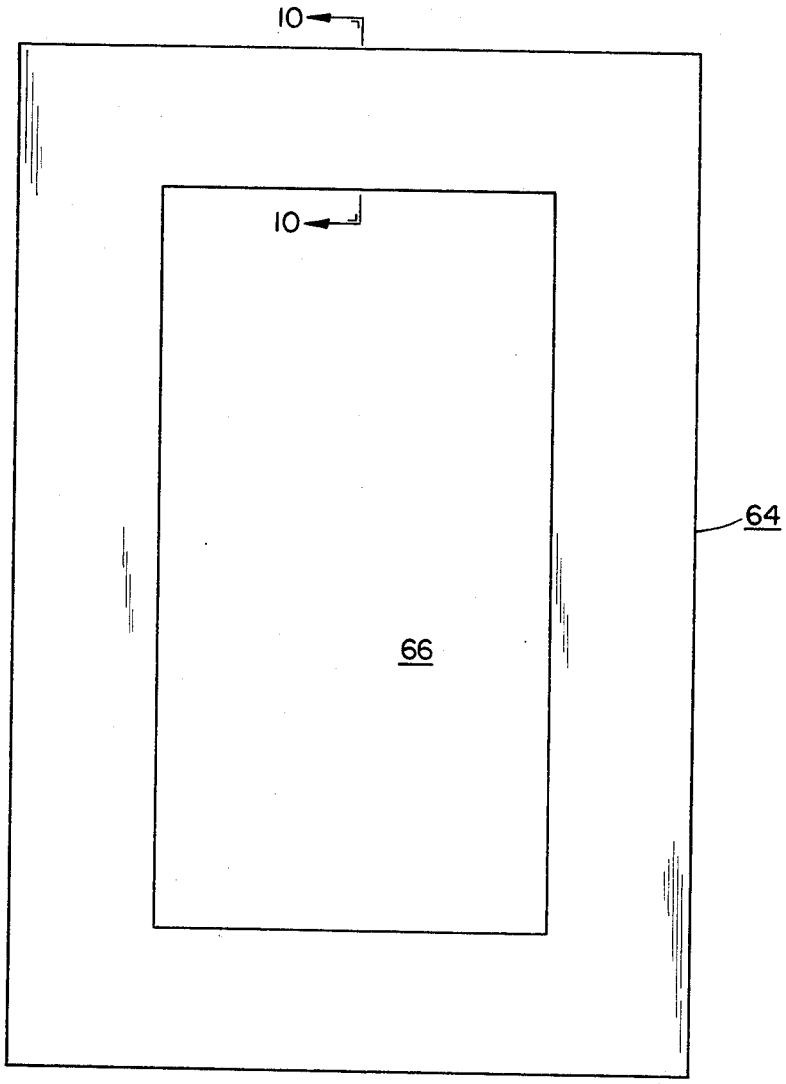
FIG. 9 illustrates a switch plate frame for fastening the wall covering fabric panel thereto.
Figure 10:
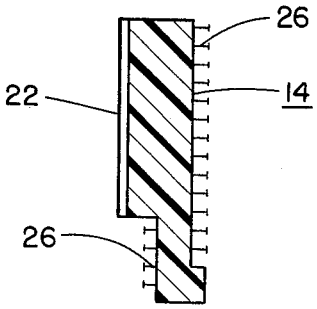
FIG. 10 illustrates a sectional view through the frame taken along line 10—10 in FIG. 9.

With respect to the embodiment of FIGS. 9 and 10, this illustrates a rectangular track member frame 64, in which a central opening 66 of the frame is adapted to be located over the opening for an electrical outlet or switch box, and wherein, as shown in cross-section in FIG. 10, the frame may have the same basic configuration as the frame member 14 illustrated in FIG. 2 of the drawings. Thus, subsequent to the superposition and mounting of the fabric panel 12 on the frame member, in which the fabric has an opening cut therein, a suitable switch plate may be superimposed on the fabric which is mounted on the frame member.

From the foregoing it readily appears that the entire system and track member is inexpensive to construct and readily installable by either semi-skilled in unskilled operators in a rapid and inexpensive installation, and allows for the repositioning of fabric panels due to the nature of the hook-and-loop fasteners permitting disengagement and reassembly between the fabric backing 32 and the hook-and-loop type fasteners 26 provided on the track members which is engaged thereby.

While there has been shown and described what are considered to be preferred embodiments of the invention, it will of course be understood that various modifications and changes in form or detail could readily be made without departing from the spirit of the invention. It is therefore intended that the invention be not limited to the exact form and detail herein shown and described, nor to anything less than the whole of the invention herein disclosed as hereinafter claimed.

What is claimed is:

1. A system for non-adherently mounting a fabric wall covering on a wall, comprising at least one track member fastened to the surface of said wall in predetermined position relative to the expanse of said wall, a recessed surface portion on said track member facing said wall to provide a space therebetween; said fabric wall covering including a fabric panel having a backing with fastener means; said fabric panel being superimposable on said track member such that the end of said fabric panel is tuckable into the space between said track member and the wall; and complementary fastener means on the front surface of said track member and on the recessed surface portion of said track member and for detachably engaging the fastener means on said fabric panel backing.

2. A system as claimed in claim 1, wherein said fastener means on said track member and on the backing of said fabric panel comprise a multiplicity of cooperating hook-and-loop fasteners.

3. A system as claimed in claim 1, wherein said track member is substantially rectangular in cross-section and includes parallel extending front and rear surfaces, said rear surface including said recessed rear surface portion at a spacing from the wall surface on which said track member is mountable, said complementary fastener means extending over the front surface and the recessed rear surface portion of said track member for engaging the fastener means on the backing of said fabric panel.

4. A system as claimed in claim 3, wherein the rear surface of said track member includes adhesive means for fastening said track member to a contacting wall surface.

5. A sytem as claimed in claim 4, wherein said adhesive means comprises a peel-and-stick adhesive tape.

6. A system as claimed in claim 3, wherein the end of said track member joining said front surface and the recessed rear surface portion is provided with said complementary fastener means for engaging the fastener means on said fabric panel backing.

7. A system for non-adherently mounting a fabric wall covering on a wall, the expanse of said walls, said fabric wall covering including a fabric panel having a backing with fastener means; first and second track members joined in a substantially L-shape for mounting fabric panels at a corner juncture of two wall surfaces, said track members being fastened to the surface of said wall in a predetermined position relative to said fabric panel being superimposable on raised surface portions of said track members extending about said wall corner juncture; and complementary fastener means on the raised front surface portions of said track members for detachably engaging the fastener means on said fabric panel backing.

8. A system as claimed in claim 7, wherein said track members are mountable on an inside wall juncture.

9. A system as claimed in claim 7, wherein said track members are mountable on an outside wall juncture.

10. A system as claimed in claim 3, wherein said track member comprises a portion of a closed framework constituted of a plurlity of track members.

11. A system as claimed in claim 3, wherein a trim base is joined to said track member so as to be coextensive therewith.

12. A system as claimed in claim 1, wherein said track member is constituted of an extruded or molded plastic material.

13. A system as claimed in claim 1, wherein said track member is constituted of metal.

14. A system as claimed in claim 13, wherein said metal is extruded aluminum.

15. A track member for the non-adherent mounting of a fabric wall covering on a wall, wherein said track member is fastened to the surface of said wall in as predetermined position relative to the expanse of said wall, a recessed surface portion on said track member facing said wall to provide a space therebetween; said fabric wall covering including a fabric panel having a backing with fastener means; said fabric panel being superimposable on said track member such that the end of said fabric panel is tuckable into the space between said track member and the wall; and complementary fastener means on the front surface of said track member and on the recessed surface portion of said track member for detachably engaging the fastener means on said fabric panel.

16. A track member as claimed in claim 15, wherein said fastener means on said track member comprise hook-and-loop fasteners adapted to cooperate with the fastener means on said fabric panel backing.

17. A track member as claimed in claim 15, wherein said track member is substantially rectangular in cross-section and includes parallel extending front and rear surfaces, said rear surface having a recessed rear surface portion at a spacing from a wall surface on which said track member is mountable, said complementary fastener means being arranged on the front surface and on the recessed rear surface portion of said track member adapted to engage the fastener means on the backing of said fabric panel.

18. A track member as claimed in claim 17, wherein the rear surface of said track member includes adhesive means for fastening said track member to a contacting wall surface.

19. A track member as claimed in claim 18, wherein said adhesive means comprises a peel-and-stick adhesive tape.

20. A track member as claimed in claim 17, wherein the end of said track member joining said front surface and the recessed rear surface portion is provided with said complementary fastener means adapted to engage the fastener means on said fabric panel backing.

21. A track member for the non-adherent mounting of a fabric wall covering on a wall wherein said track member includes first and second track portions joined in a substantially L-shaped fasted to the surface of a corner juncture of two surfaces of said wall in a predetermined position relative to the expanse of said wall, said fabric wall covering including a fabric panel having a backing with fastener means; said fabric panel being superimposable on raised surfaces of said track member extending about said wall corner; and complementary fastener means on the raised front surface of said track member for detachable engaging the fastener means on said fabric panel.

22. A track member as claimed in claim 21, wherein said track members are mountable on an inside wall juncture.

23. A track member as claimed in claim 20, wherein said track members are mountable on an outside wall juncture.

24. A track member as claimed in claim 17, wherein said track member comprises a portion of a closed framework constituted of a plurality of track members.

25. A track member as claimed in claim 17, wherein a trim base is joined to said track member so as to be coextensive therewith.

26. A track member as claimed in claim 15, wherein said track member is constituted of an extruded or molded plastic material.

27. A track member as claimed in claim 15, wherein said track member is constituted of metal.

28. A track member as claimed in claim 27, wherein said metal is extruded aluminum.

* * * * *